US012188343B2

(12) United States Patent
Elizondo et al.

(10) Patent No.: US 12,188,343 B2
(45) Date of Patent: Jan. 7, 2025

(54) SENSOR AND ACTUATOR FOR AUTONOMOUSLY DETECTING RESISTIVITY DERIVATIVES OF WELLBORE FLUIDS AND CLOSING FLUID PATH

(71) Applicant: Halliburton Energy Services, Inc., Houston, TX (US)

(72) Inventors: Hector Jesus Elizondo, Houston, TX (US); Ritesh Dharmendra Panchal, Houston, TX (US); Jinhua Cao, Houston, TX (US); Ishwar Patil, Houston, TX (US); Paul J Jones, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 367 days.

(21) Appl. No.: 17/815,248

(22) Filed: Jul. 27, 2022

(65) Prior Publication Data

US 2024/0035370 A1 Feb. 1, 2024

(51) Int. Cl.

| | |
|---|---|
| ***G06F 11/30*** | (2006.01) |
| ***E21B 33/14*** | (2006.01) |
| ***E21B 47/005*** | (2012.01) |

(52) U.S. Cl.

CPC ..... *E21B 47/005* (2020.05); *E21B 33/14* (2013.01)

(58) Field of Classification Search

CPC ..... E21B 47/005; E21B 33/14

See application file for complete search history.

(56) References Cited

U.S. PATENT DOCUMENTS

| | | | | |
|---|---|---|---|---|
| 2008/0060803 | A1* | 3/2008 | Badalamenti | E21B 21/10 166/242.8 |
| 2017/0074070 | A1* | 3/2017 | Hay | E21B 34/14 |
| 2017/0247959 | A1* | 8/2017 | Dirksen | E21B 21/12 |
| 2022/0120172 | A1* | 4/2022 | Luo | E21B 34/066 |

FOREIGN PATENT DOCUMENTS

WO 2003087520 A2 10/2003

OTHER PUBLICATIONS

Written Opinion for PCT/US2023/065707, Jul. 25, 2023 (Year: 2023).*

* cited by examiner

*Primary Examiner* — Phuong Huynh
(74) *Attorney, Agent, or Firm* — Sheri Higgins; Sheri Higgins Law, PLLC

(57) ABSTRACT

A sensor device can be used to detect the presence of a cement composition in a reverse cementing operation. The sensor device can include a resistivity sensor, an acquisition and measurement apparatus, and an actuator. The actual derivative of resistivity of the drilling mud, spacer fluid, and cement composition to be used can be pre-determined. The acquisition and measurement apparatus can be pre-programmed with a slope change derivative of resistivity profile for the fluids. The resistivity sensor can measure the resistivity of the fluids as they flow past the resistivity sensor in the wellbore. When the acquisition and measurement apparatus receives a desired slope change reading within the slope change derivative of resistivity profile, instructions can be sent to the actuator to close a valve and block fluid flow through the casing or tubing string.

20 Claims, 9 Drawing Sheets

SENSOR AND ACTUATOR FOR AUTONOMOUSLY DETECTING RESISTIVITY DERIVATIVES OF WELLBORE FLUIDS AND CLOSING FLUID PATH

TECHNICAL FIELD

The field relates to a sensor used to detect the presence of different types of fluids in a reverse cementing operation. The sensor can be a resistivity sensor used to detect changes in the derivatives of resistivity with respect to time. When cement is detected by the sensor, an actuator can close a valve that closes a fluid flow path.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
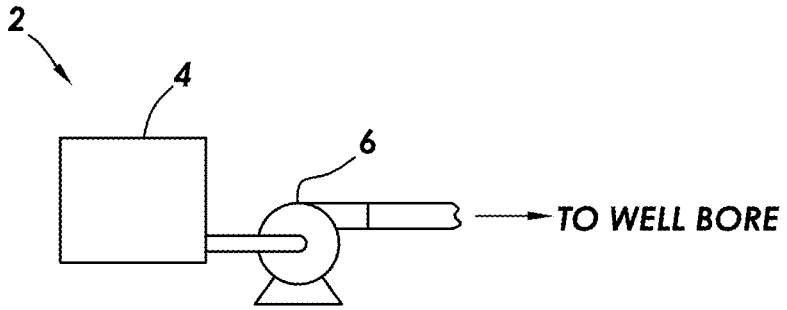
FIG. 1 illustrates a system for preparation and delivery of a cement composition to a wellbore according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe. A drilling fluid can include a base fluid of a hydrocarbon liquid (commonly referred to as an oil-based mud), a base fluid of a synthetic oil (commonly referred to as a synthetic-based mud), or a base fluid comprising water (commonly referred to as a water-based mud).

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing string is placed into the wellbore that can also contain a tubing string. A wellbore can contain an annulus. Examples of an annulus include but are not limited to: the space between the wall of the wellbore and the outside of a tubing string in an open-hole wellbore; the space between the wall of the wellbore and the outside of a casing string in a cased-hole wellbore; and the space between the inside of a casing and the outside of a tubing string in a cased-hole wellbore.

During well completion, it is common to introduce a cement composition into an annulus in a wellbore. For example, in a cased-hole wellbore, a cement composition can be placed into and allowed to set in the annulus between the wall of the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

As used herein, a "cement composition" is a mixture of at least cement and water. A cement composition can include additives. As used herein, the term "cement" means an initially dry substance that develops compressive strength or sets in the presence of water. Some examples of cements include, but are not limited to, Portland cements, gypsum cements, high alumina content cements, slag cements, high magnesia content cements, sorel cements, and combinations thereof. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a casing string or tubing string and up through the annulus or down through the annulus and up through the casing or tubing string. The spacer fluid functions to remove the drilling fluid from the wellbore, so the cement composition encounters a better bonding surface. The spacer fluid pushes the drilling fluid through the wellbore, and a cement composition is then introduced after the spacer fluid.

A cement composition should remain pumpable during introduction into a wellbore. A cement composition will ultimately set after placement into the wellbore. As used herein, the term "set," and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set.

Reverse cementing operations were developed to overcome some of the disadvantages to traditional cement operations. For example, in traditional cementing operations, the setting time of the cement composition needs to be longer in order for the cement slurry to remain pumpable as it travels through the casing or an inner tubing string and back up into the annulus before setting. In reverse cementing by contrast, the cement slurry is pumped directly from the wellhead into the annulus instead of into the annulus via the casing string or tubing string—essentially cutting the amount of cement needed in half and shortening the setting time. Accordingly, reverse cementing can have faster setting times because it takes less time to pump the cement into the annulus and requires lower pump pressures because gravity assists the cement slurry in being placed in the annulus.

In all cementing operations, it is desirable to place the minimum amount of cement necessary to fill the portions of the annulus to be cemented. In traditional cementing, the amount of cement needed for the cementing operation can be estimated by the well geometry, and cement is pumped down the casing string with an excess amount. A cement plug can be placed behind the cement slurry column and will bump onto the casing shoe. An operator can tell by a pressure change observed at the wellhead that is caused by the cement plug reaching the casing shoe or collar. The operator can then cease pumping of the cement composition into the casing string or tubing string. However, in reverse cementing operations, there are no visual observations that can be made to know when the cement composition has reached the bottom of the casing or tubing string and filled the annulus. Therefore, devices can be placed near the bottom of the casing or tubing string that can detect the presence of the cement composition.

Devices used to detect the presence of a cement composition can include a sensor. Generally, the sensor is connected to equipment at the wellhead that communicates with a readout device in order for an operator to monitor the measurements. By way of example, the sensor can be connected to equipment at the wellhead via wireline. An operator can monitor the readings from the sensor and cease pumping the cement composition when the readings indicate the presence of cement. However, wireline connections can be expensive and time-consuming.

Moreover, sensors placed on the outside of a casing or tubing string can be unpredictable and unreliable. After run-in, the longitudinal axis of the casing or tubing string is rarely perfectly centered inside the wellbore wall. Accordingly, one or more areas of the annulus will have a decreased volume compared to other areas of the annulus. Fluids pumped into the annulus will also generally take the path of least resistance, which are the areas of the annulus that have the largest volume. Therefore, if a sensor is located on the outside of a casing string that is in a lower volume area of the annulus for example, then fluid may bypass the sensor and detection of the presence of the cement composition may be missed.

A resistivity sensor can detect the resistivities of wellbore fluids. However, the differences in resistivity of different wellbore fluids can be quite small. By way of example, the difference in resistivity between a water-based drilling fluid and a spacer fluid can be only 2 ohm meter (Ω-m); while the difference in resistivity between the spacer fluid and a cement composition can be only 9 Ω-m. Additionally, there is most commonly some intermixing of different fluids at the fluid's interface. For example, when displacing a spacer fluid with a cement composition, some intermixing of the spacer fluid with the cement composition can occur at the interface between the two fluids. Accordingly, even if a specific resistivity value can be determined for a specific fluid, complications can occur when fluids pumped into a wellbore experience intermixing with adjacent fluids and their intrinsic properties become altered, thus leading to increased risk and reduced reliability of the sensor. Thus, there is a need for improved sensors that are more sensitive in predictably and reliably detecting the presence of a cement composition in a reverse cementing operation and overcome the aforementioned problems.

It has been discovered that a resistivity sensor can use the derivatives of resistivity to determine the presence of different wellbore fluids. The resistivity sensor can be pre-programmed at the wellhead that corresponds to a unique and specific slope change in the measurements based on the derivative of resistivity of the exact composition of the fluids used as the fluids pass by the sensor. The resistivity sensor uses the pre-programmed profile to autonomously close a valve located within the casing or tubing string. When the valve closes, fluid flow up the casing or tubing string ceases and a change in pressure at the wellhead can be observed—thus, alerting an operator that the cement composition has filled the annulus and pumping can cease.

A reverse cementing sensor device can include: a resistivity sensor configured to measure the resistivity of a fluid; an acquisition and measurement apparatus configured to: (i) process the measured resistivity to determine an average derivative of resistivity with respect to time; (ii) determine a plurality of slope changes based on the average derivative of resistivity with respect to time; (iii) be pre-programmed with a slope change profile of the slope changes; and (iv) receive readings from the resistivity sensor; an actuator configured to receive instructions from the acquisition and measurement apparatus; and a valve, wherein the valve is located inside of a casing string or tubing string, wherein the acquisition and measurement apparatus is configured to send instructions to the actuator to close the valve after the acquisition and measurement apparatus determines a desired slope change within the pre-programmed slope change profile.

Methods of detecting the presence of a cement composition in a reverse cementing operation in a wellbore can include introducing the resistivity sensor into the wellbore; pre-programming the acquisition and measurement apparatus with the desired slope change and the slope change profile; introducing a first fluid into the wellbore; introducing a cement composition into an annulus of the wellbore; allowing the resistivity sensor to measure the resistivity of the first fluid and the cement composition; and allowing the acquisition and measurement apparatus to instruct the actuator to close a valve.

It is to be understood that the discussion of any of the embodiments regarding the sensor device is intended to apply to all of the apparatus and method embodiments. Any reference to the unit "gallons" means U.S. gallons.

FIG. 1 illustrates a system 2 that can be used in the preparation of wellbore fluids and delivery to a wellbore according to any of the embodiments. Although the discussion below is in reference to a cement composition, it is to be understood that other wellbore fluids, for example a drilling fluid or spacer fluid, can be prepared and delivered as described. As shown, the cement composition can be mixed in mixing equipment 4, such as a jet mixer, recirculating mixer, or a batch mixer, for example, and then pumped via pumping equipment 6 to the wellbore. The mixing equipment 4 and the pumping equipment 6 can be located on one or more cement trucks. A jet mixer can be used, for example, to continuously mix the cement composition, including water, as it is being pumped to the wellbore.

Figure 2A:
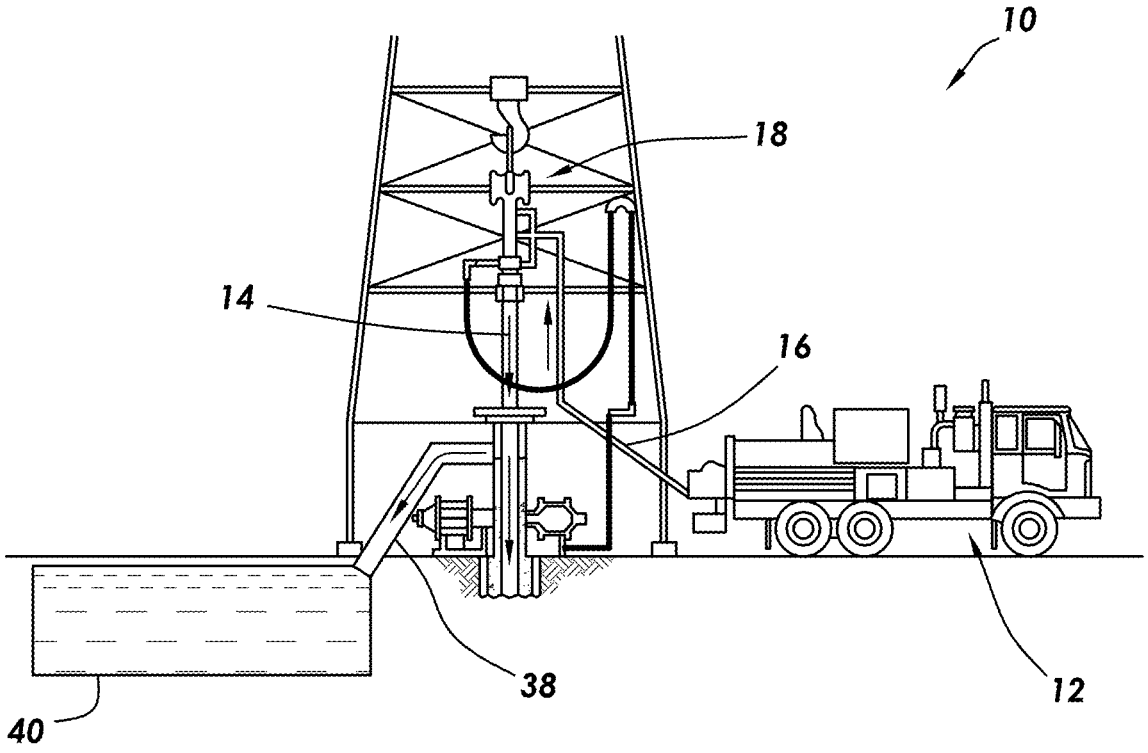
FIG. 2A illustrates surface equipment that may be used in placement of a cement composition into a wellbore.

An example technique and system for introducing the cement composition into a subterranean formation will now be described with reference to FIGS. 2A and 2B. FIG. 2A illustrates surface equipment 10 that can be used to introduce the cement composition. It should be noted that while FIG. 2A generally depicts a land-based operation, those skilled in the art will readily recognize that the principles described herein are equally applicable to subsea operations that employ floating or sea-based platforms and rigs, without departing from the scope of the disclosure. The surface equipment 10 can include a cementing unit 12, which can include one or more cement trucks, mixing equipment 4, and pumping equipment 6 (e.g., as depicted in FIG. 1). The cementing unit 12 can pump the cement composition 14 through a feed pipe 16 and to a cementing head 18, which conveys the cement composition 14 downhole.

The methods include introducing a first fluid 44 into a wellbore. The first fluid can be a drilling fluid. The drilling fluid can be used to form a wellbore in a subterranean formation via a drilling operation. The drilling fluid can be, without limitation, an oil-based drilling mud, a synthetic-based drilling mud, or a water-based drilling mud.

The methods include introducing a cement composition into an annulus of the wellbore for a reverse cementing operation. Turning now to FIG. 2B, the cement composition 14 can be introduced into an annulus 32 of the wellbore 22. The step of introducing can include pumping the cement composition into the wellbore using one or more pumps 6. The step of introducing can be for the purpose of at least one of the following: well completion; foam cementing; primary or secondary cementing operations; well-plugging; squeeze cementing; and gravel packing. The cement composition can be in a pumpable state before and during introduction into the annulus 32. The subterranean formation 20 is penetrated by the wellbore 22. The well can be, without limitation, an oil, gas, or water production well, an injection well, a geothermal well, or a high-temperature and high-pressure (HTHP) well. The wellbore 22 comprises walls 24. A surface casing 28 can be inserted into the wellbore 22. The surface casing 28 can be cemented to the walls 24 via a cement sheath 26. One or more additional conduits (e.g., intermediate casing, production casing, liners, etc.) shown here as casing 30 can also be disposed in the wellbore 22. One or more centralizers 34 can be attached to the casing 30, for example, to centralize the casing 30 in the wellbore 22 prior to and during the reverse cementing operation. The well can include an annulus 32 formed between the outside of the casing 30 and the walls 24 of the wellbore 22 and/or the surface casing 28.

Figure 2B:
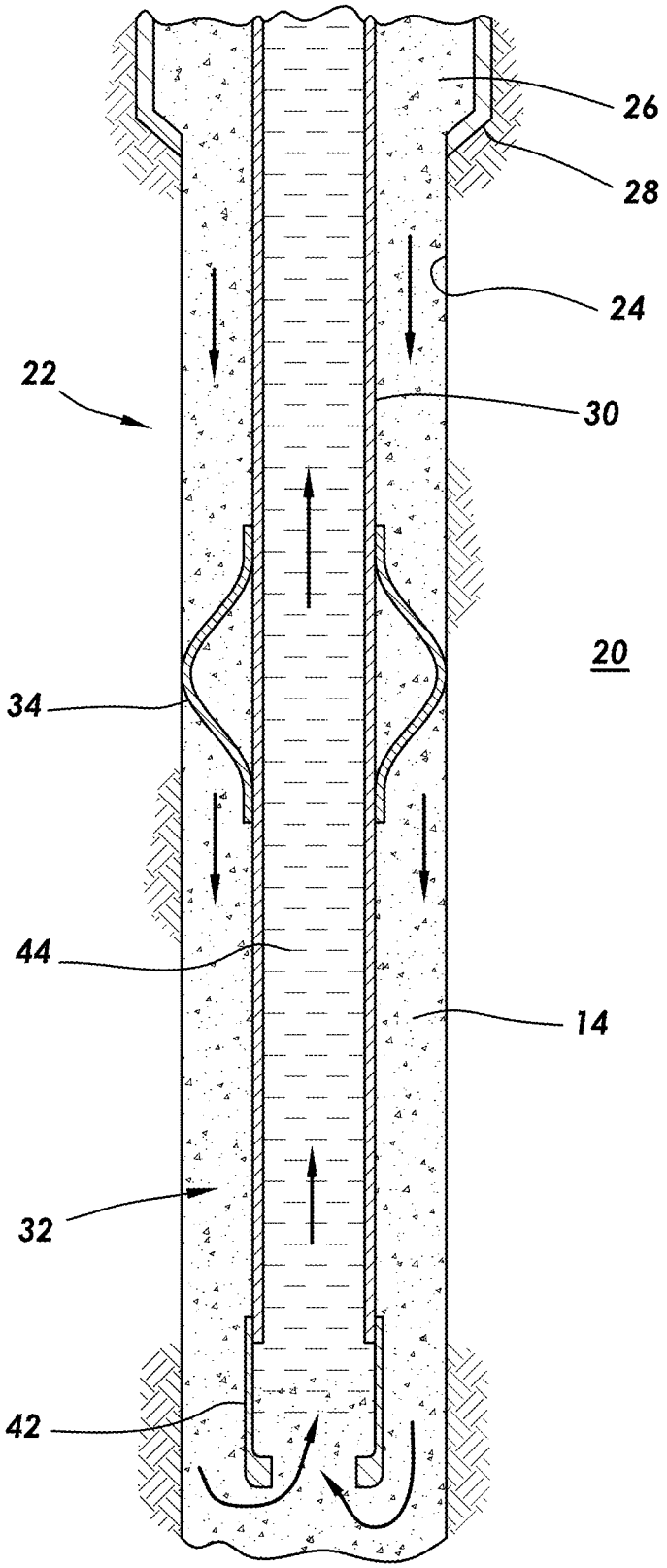
FIG. 2B illustrates placement of a cement composition into an annulus of a wellbore for a reverse cementing operation.

With continued reference to FIG. 2B, the cement composition 14 can be pumped down the annulus 32 in the direction indicated by the arrows. The cement composition 14 can be allowed to flow down the annulus 32, through a casing shoe 42 at the bottom of the casing 30, and up inside the casing 30. As it is introduced, the cement composition 14 can displace the first fluid 44 that is present in the interior of the casing 30 and/or the annulus 32. Although not show, a second fluid can be introduced into the wellbore 22 after the first fluid. The second fluid can be, for example, a spacer fluid. The cement composition 14 can displace the first fluid and the second fluid. At least a portion of the displaced fluids can exit the casing 30 via a flow line 38 and be deposited, for example, in one or more retention pits 40 (e.g., a mud pit), as shown on FIG. 2A.

Figure 3:
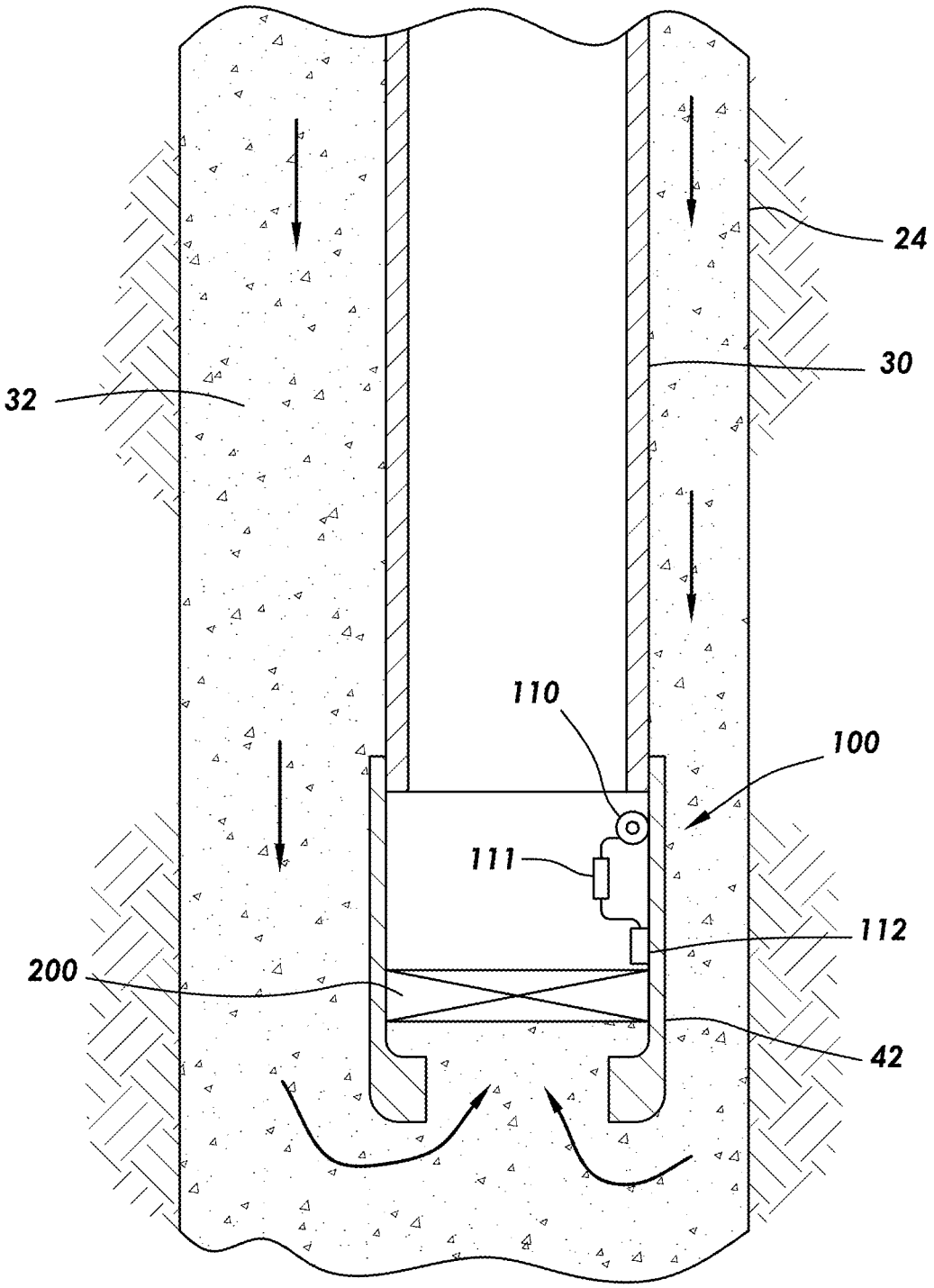
FIG. 3 illustrates a reverse cementing sensor device located inside a casing string to detect different types of wellbore fluids according to certain embodiments.

FIG. 3 is an illustration of a reverse cementing sensor device 100. The sensor device 100 can include a resistivity sensor 110. The resistivity sensor 110 is configured to measure the resistivity of a fluid. Most rock materials in a subterranean formation are essentially electrical insulators, while their enclosed fluids are electrical conductors. For fluids, the electrical charge carriers are only the ions present in fluid, for example, salt ions in brackish water. In the absence of dissolved ions, water is a very poor electrical conductor. Electrical resistivity is a fundamental property of a material that measures how strongly it resists electric current. A low resistivity indicates a material that readily allows electric current. Resistivity (ρ) can be measured by injecting a signal into the wellbore and measuring voltage and current through the unit length of electrodes as shown in FIG. 4 denoted by Equation 1.

$$\rho = E/J \qquad \text{EQ. 1}$$

where ρ is the electrical resistivity of the material in ohm-meter "Ω-m", E is the magnitude of the electric field in the material in voltage per meter "V/m", and J is the magnitude of the electric current density in the material in ampere per meter squared "$A/m^2$". By way of example, if a 1 cubic meter solid cube of material has sheet contacts on two opposite faces, and the resistance between these contacts is 1Ω, then the resistivity of the material is 1 Ω-m.

Figure 4:
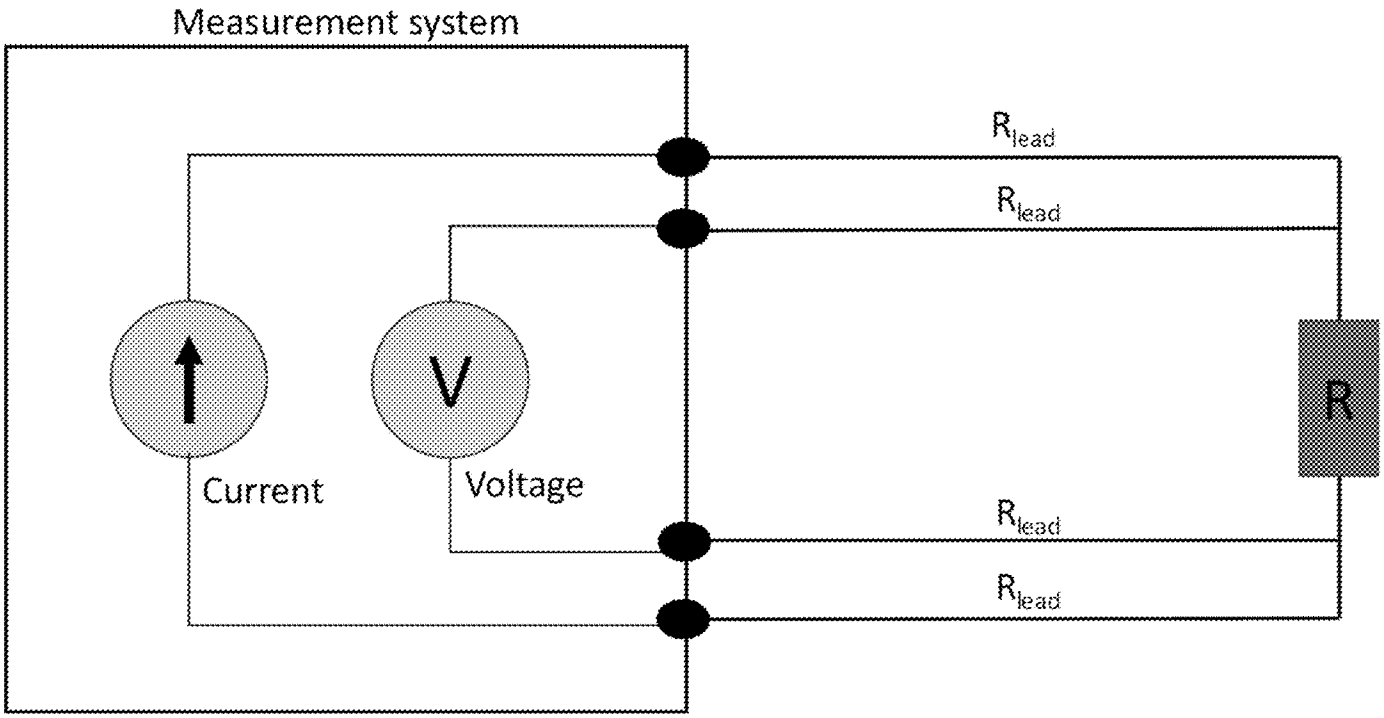
FIG. 4 illustrates a resistivity measurement apparatus according to certain embodiments.

The resistivity sensor 110 can include other components necessary to measure the resistivity of a fluid as shown in FIG. 4. According to any of the embodiments, the resistivity sensor 110 includes a source of electrical current and frequency, a voltage measurement system (e.g., a voltmeter), electrodes, and cables connecting the components to one or more electrodes.

Turning back to FIG. 3, the sensor device 100 can be located on an inside of the casing string 30. The sensor device 100 can also be located on the inside of a tubing string. The annulus 32 can be located between the outside of the casing string 30 and the wall 24 of the wellbore 22 for an open-hole wellbore or located between the outside of a tubing string and the inside of a casing string (not shown) for a cased-hole wellbore. In this manner, fluids flowing inside the casing string or tubing string will more predictably and reliably make contact with the resistivity sensor 110.

Still with reference to FIG. 3, the sensor device 100 includes an acquisition and measurement apparatus 111. The acquisition and measurement apparatus 111 can be a controller board. The acquisition and measurement apparatus 111 is configured to process the measured resistivity to determine the average derivative of resistivity with respect to time. The acquisition and measurement apparatus 111 is configured to determine a plurality of slope changes based on the average derivative of resistivity with respect to time and be pre-programmed with a slope change profile of the slope changes. The acquisition and measurement apparatus 111 is configured to receive readings from the resistivity sensor 110. The methods can include pre-programming the acquisition and measurement apparatus 111 with a desired slope change and the slope change profile.

The exact composition of the first fluid, the cement composition, and optionally a second, third, etc. fluids can differ. By way of example, an oil-based drilling mud may be used in one subterranean formation while a water-based drilling fluid may be used in a different subterranean formation. Also, the ingredients in each type of wellbore fluid can be different based on the exact subterranean formation makeup and the specific wellbore conditions. Accordingly, the resistivity can be different depending on the exact composition for a particular wellbore fluid.

Figure 5:
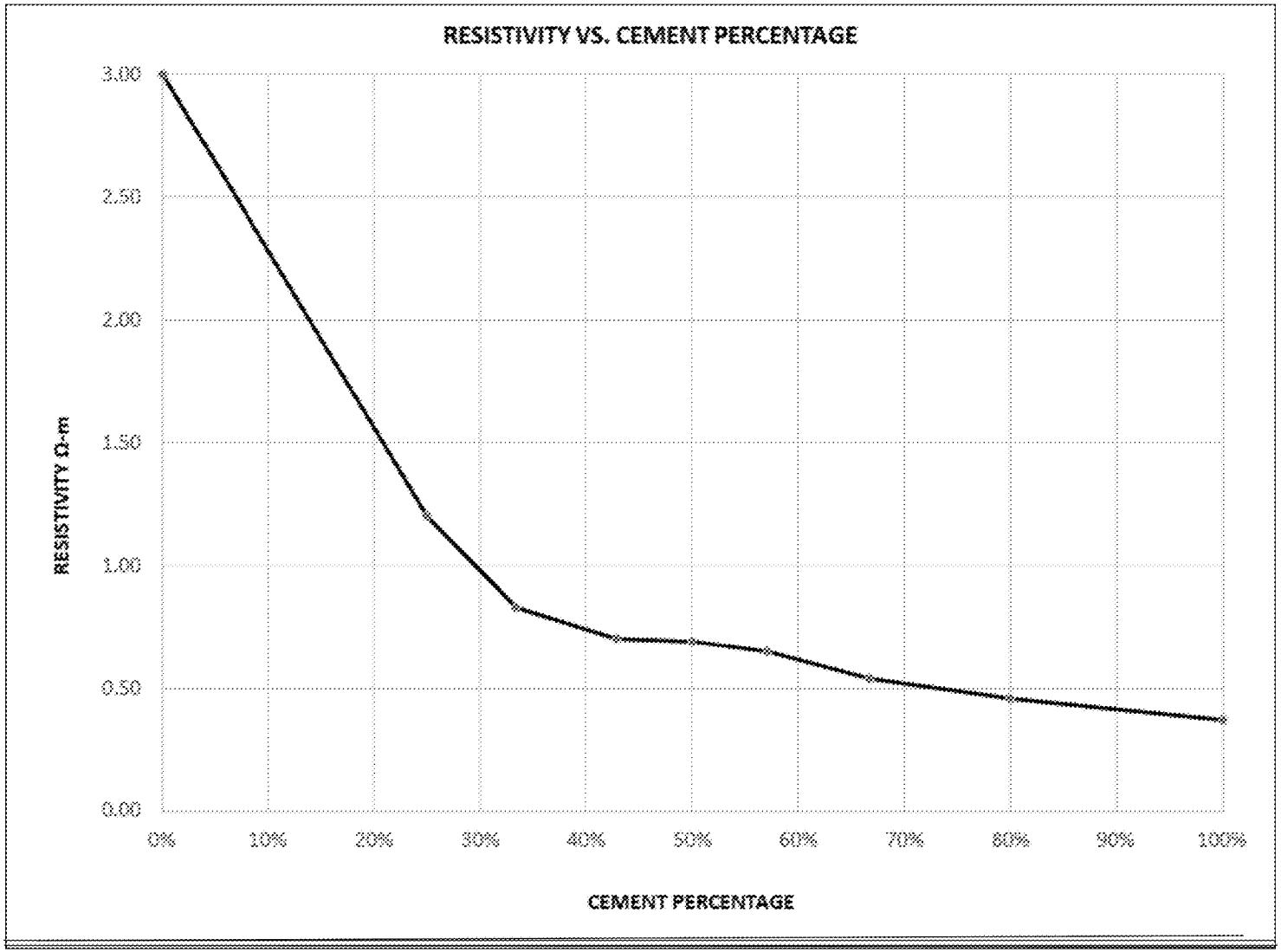
FIG. 5 is a graph of resistivity in Ω-m versus cement percentage.

By way of example and as shown in FIG. 5, the change in resistivity between fluids is rarely instantaneously observed. This is because most commonly there is some mixing of two different fluids at the fluid's interface. For example, when a spacer fluid is introduced into the annulus, some of the spacer fluid mixes with some of the drilling fluid at the top of the column. The cement composition can then mix with some of the spacer fluid at the top of the column. As can be seen in FIG. 5, as the cement composition is introduced into the annulus and begins to displace the spacer fluid, the percentage of the cement composition flowing past a particular location within the annulus gradually increases from initially being 0% (all spacer fluid is flowing past) to eventually being 100% (all cement composition is flowing past). Accordingly, the ratio of cement composition to spacer fluid in the mixed fluid gradually increases. The resistivity of the mixed fluid will change depending on the concentrations of spacer fluid and cement in the mixed fluid as the fluids are flowing through the wellbore. As can be seen, the resistivity can be approximately 1.5 Ω-m at 20% cement and 80% spacer fluid. However, the resistivity can be approximately 0.5 Ω-m at 80% cement and 20% spacer fluid. Such minute changes in resistivity—namely a value change of only 1 Ω-m—are difficult to reliably detect. Accordingly, the detection of a cement composition may be missed, and the valve may not be instructed to close.

Figure 6:
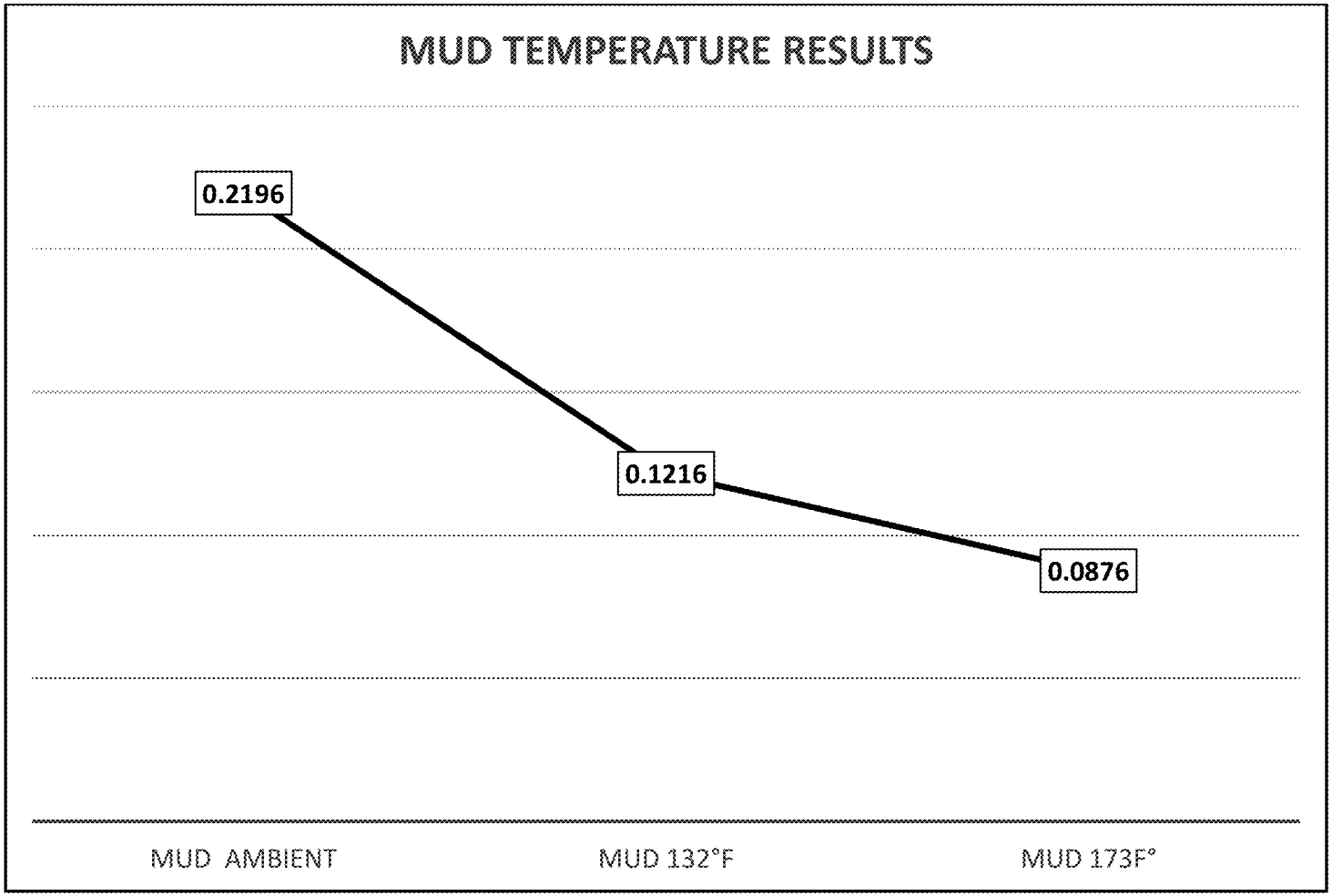
FIG. 6 is a graph of resistivity in Ω-m for a water-based drilling fluid at different temperatures.
Figure 7:
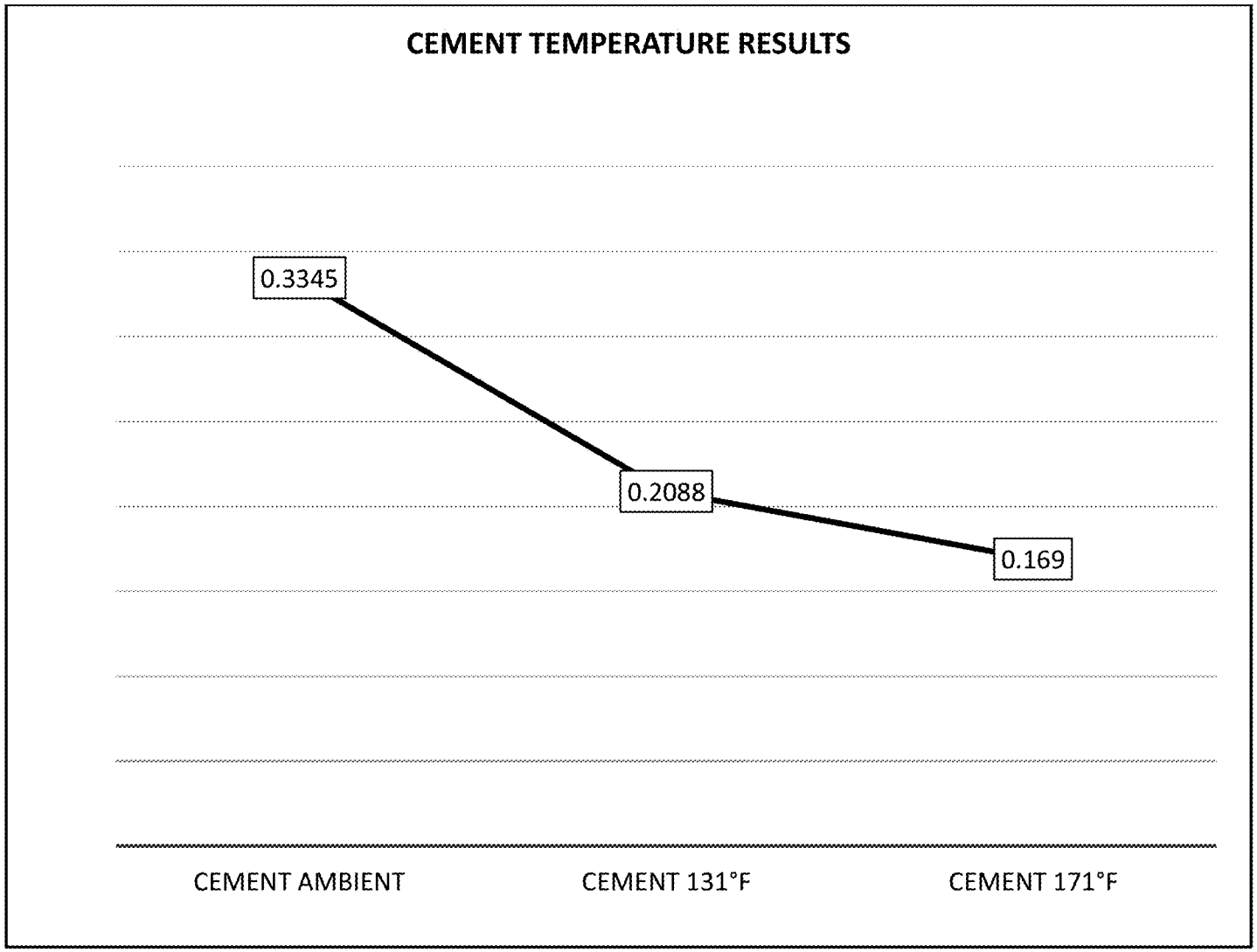
FIG. 7 is a graph of resistivity in Ω-m for a cement composition at different temperatures.

Moreover, as can be seen in FIGS. 6 and 7, the difference in resistivity for a specific fluid at different temperatures can be extremely small. If a sensor is pre-programmed based on actual resistivity values, then the transition from a fluid (e.g., a spacer fluid) to a cement composition can be missed if the exact wellbore temperature is not completely accurate.

The slope change of the average derivative of resistivity with respect to time can be much greater than the change in actual resistivity values. The derivative of a function of a single variable at a chosen input value is the slope of the tangent line to the graph of the function at that point in time. The tangent line is the best linear approximation of the function near that input value. For this reason, the derivative is often described as the "instantaneous rate of change," which is the ratio of the instantaneous change in the dependent variable to that of the independent variable. The slope change of the derivative of resistivity to the derivative of time (dr/dt) can change as different fluids having different resistivities flow past the sensor.

Figure 8A:
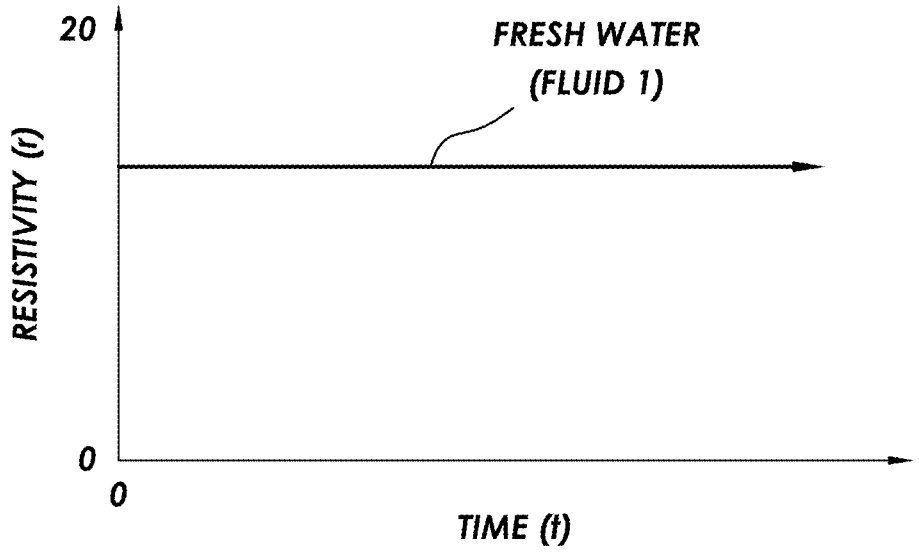
FIGS. 8A-8D illustrate changes in resistivity values over time and the derivative resistivity over time for fresh water and salt water.
Figure 8B:
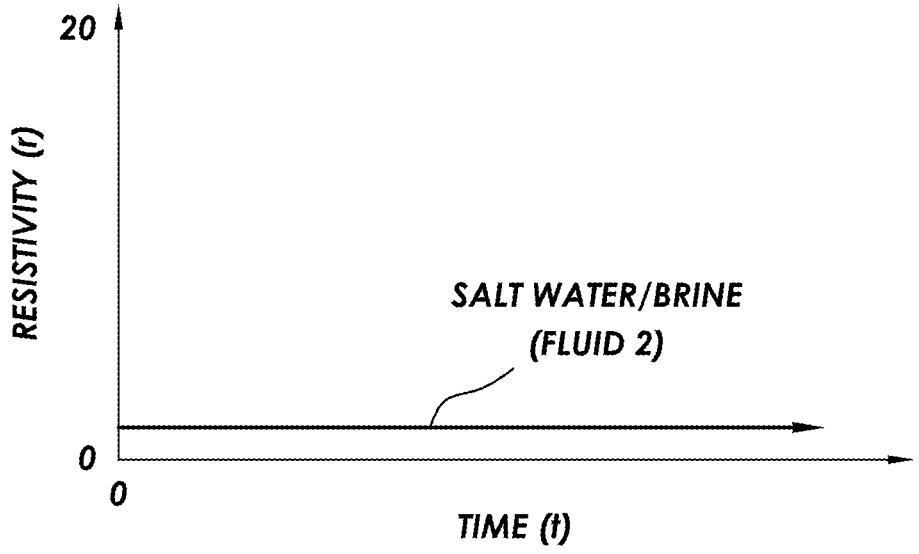
Figure 8C:
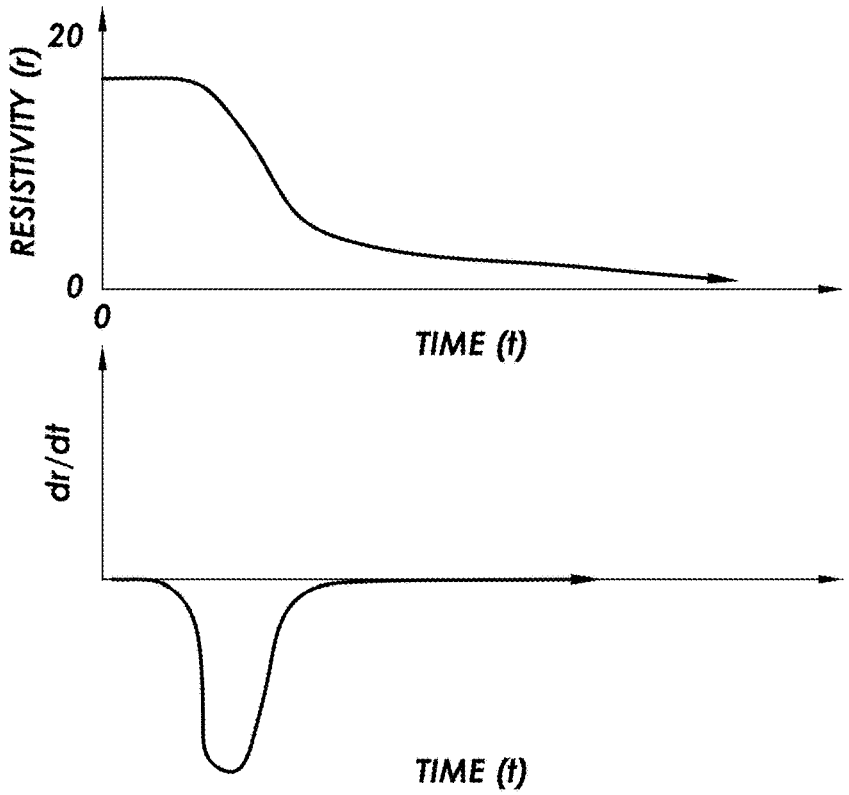
Figure 8D:
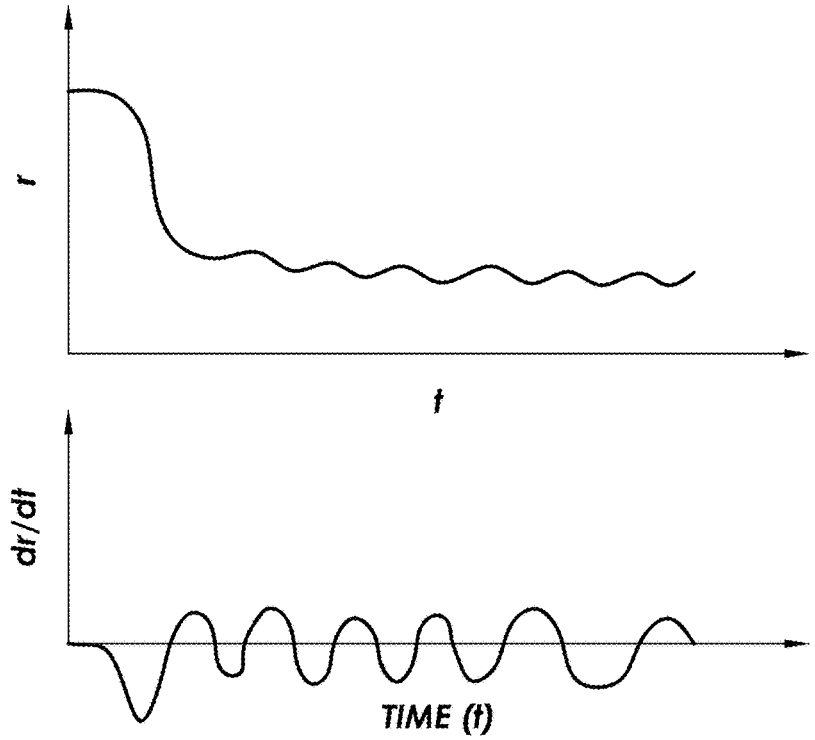

By way of example, FIG. 8A shows the resistivity value versus time for a freshwater fluid, and FIG. 8B shows the resistivity value versus time for a saltwater fluid. If the freshwater fluid is displaced by the saltwater fluid, then the resistivity profile can be illustrated in FIG. 8C; however, the slope changes of the average derivative of resistivity with respect to time can be much easier to detect as going from a negative slope to a positive slope. As can be seen in FIG. 8D, the changes in resistivity values when alternating freshwater and saltwater can be very small; however, the slope changes of the average derivative of resistivity with respect to time can be much greater and easier to detect. By measuring a specific property over time and continuously calculating the derivative over a period of time, the magnitude of the property becomes irrelevant and only the change in property over a specific time period can be used to signal an event. For example, as illustrated in FIG. 8D, alternating pumping of fresh water and salt water will produce a fluid having a resistivity lower than pure water but higher than salt water, making the determination of when to program the valve to close difficult. However, when the derivative of resistivity with respect to time is determined based on measured resistivity values and used for triggering actuation of the valve, only the sequence of increasing and decreasing resistivity matters rather than the actual value. In the case of an alternating pumping sequence of fresh water and salt water, a plot of the derivative of resistivity with respect to time will appear as a sine wave with the slopes alternating between positive and negative values.

Different fluids can be used in reverse cementing operations. A first fluid, for example a drilling mud, can be used to form a wellbore. The drilling mud will have a unique resistivity depending on the ingredients and concentrations in the drilling mud. A casing string and/or tubing string can be installed in the wellbore. A second fluid, for example a spacer fluid, can be introduced into an annulus of the wellbore. A cement composition can then be introduced into the annulus after the spacer fluid. The drilling mud and the spacer fluid can be pushed down the annulus and up into the casing or tubing string by the cement composition.

The methods include pre-programming the acquisition and measurement apparatus with a desired slope change of the pre-programmed slope change profile. The methods can further include pre-determining the resistivity for each of the specific fluids used in the reverse cementing operation. The step of pre-determining the resistivity for each of the specific fluids can include preparing a test fluid wherein the test fluid is identical to the fluids used in the reverse cementing operation (i.e., the test fluid has the same ingredients and in the same concentration as the fluid used in the operation). For example, the resistivity of test fluids corresponding to the drilling fluid, spacer fluid, and cement composition to be used at a specific well site can be tested in a laboratory to determine the exact resistivity for those fluids. Laboratory testing can be performed off-site or at the well site. The test fluids can be an aliquot of the actual fluids to be used or more commonly, can be a prepared sample.

Once the resistivity of each fluid used in the oil or gas operation is pre-determined, the length of time each fluid is estimated to flow past the resistivity sensor can be pre-determined. For example, it may take 4 hours for the first fluid (e.g., a drilling fluid) to flow past the resistivity sensor after a second fluid (e.g., a spacer fluid) in pumped into the annulus. The methods can further include calculating the derivative of resistivity to the derivative of time to determine the slope changes on the calculated measurements for resistivity. It is to be understood that the derivatives (dr/dt) are calculated based on the actual resistivities of the specific fluids to be used to produce a slope change on the calculated measurements for resistivity, for example, as illustrated in FIGS. 8C and 8D. The acquisition and measurement apparatus can be pre-programmed with the desired slope change within the pre-programmed slope change profile of the slope changes. The acquisition and measurement apparatus can also be pre-programmed with the resistivity values of the fluids in addition to the slope change profile of the slope changes. In this manner, initiation of closing of the valve is triggered once the measured value of resistivity and the desired slope change meet pre-determined criteria.

It is to be understood that unlike other sensors and methods of detecting the presence of a fluid, the specific derivative of resistivity of the fluids to be used for a specific well are pre-determined via laboratory testing, the slope changes on the calculated measurement for resistivity is then determined based on the average derivative of resistivity with respect to time of the specific fluid and the length of time, and the desired slope change within the slope change profile is pre-programmed into the acquisition and measurement apparatus at the wellhead.

The methods can include introducing the sensor device 100 into the wellbore. The sensor device 100 can be installed on an inside and near a bottom of the casing string or tubing string prior to being run into the well. The casing string can be run into the well during drilling operations for example. The step of introducing can be running in of the casing string or tubing string. The sensor device 100 is intended to remain within the casing string or tubing string after introduction into the wellbore, that is, the sensor device 100 is not intended to be retrieved from the wellbore after use. According to any of the embodiments, the sensor device 100 can be used one time after introduction into the wellbore.

Any of the components of the sensor device 100, such as the acquisition and measurement apparatus 111, can be powered by a power source. The power source can be batteries. It is to be understood that none of the components of the sensor device 100 receive direct power from the wellhead. According to any of the embodiments, the sensor device 100 can be put in sleep mode during introduction into the wellbore. Sleep mode can preserve available power from the power source. For example, it is not uncommon for the casing string to take 24 hours or more to be run into the well. Therefore, the sensor device 100 can be pre-programmed to be in sleep mode during run in. The sensor device 100 can also be programmed to wake up from sleep mode after a desired length of time. The desired length of time can be a time before, at, or after the time to run the casing string or tubing string into the well. By way of example, if it is estimated to take 24 hours to run the casing string into the well, then the sensor device 100 can be programmed to wake up from sleep mode after 20 hours to 25 hours.

The methods can include allowing the resistivity sensor 110 to measure the resistivity of the first fluid and the cement composition. The resistivity sensor 110 can also measure the resistivity of the second fluid, third fluid, etc. if used. The resistivity sensor 110 can continually measure the resistivity of the different types of fluids as they flow past the resistivity sensor. The resistivity sensor can also be instructed by the acquisition and measurement apparatus 111 to take readings at a desired time interval, for example, every 5 minutes. The resistivity sensor can also be instructed to take readings after one or more specific times have elapsed, for example, at 2 hours and 4 hours. This embodiment can be useful in order to conserve power and can be coordinated based on the estimated time it will take for a different type of fluid to reach the resistivity sensor.

The acquisition and measurement apparatus 111 can also instruct the resistivity sensor 110 to take readings at a desired time interval after a specific time has elapsed. By way of example, if it is estimated to take 4 hours for a spacer fluid and 8 hours for the cement composition to reach the resistivity sensor, then the acquisition and measurement apparatus can instruct the resistivity sensor to begin taking readings every 4 minutes beginning after 3.5 hours have elapsed since the spacer fluid began being pumped into the well. The acquisition and measurement apparatus can then optionally instruct the resistivity sensor to cease taking readings, for example, when the resistivity measures the specific resistivity of the spacer fluid, which would indicate 100% of the fluid flowing past the resistivity sensor is spacer fluid and not a mixture of spacer fluid and drilling mud. The acquisition and measurement apparatus can then instruct the resistivity sensor to begin taking readings every 4 minutes after 7.5 hours have elapsed since the cement composition began being pumped into the annulus. Of course, shorter or longer time intervals can be used instead of the every-4-minutes example, and different elapsed times can also be used instead of 30 minutes before the estimated time example.

Turning back to FIG. 3, the sensor device 100 can further an actuator 112. The actuator 112 is configured to receive instructions from the acquisition and measurement apparatus 111. The acquisition and measurement apparatus 111 can be in wired communication with the resistivity sensor 110 and the actuator 112 in order to receive readings and send instructions. A valve 200 can be located inside the casing string 30 or a tubing string. The valve 200 can be located at or near a bottom of the casing or tubing string. The valve 200 can be located below the sensor device 100. The valve 200 can be any type of valve, for example a flapper valve or sliding sleeve, that allows fluid to flow up into the casing or tubing string when in an open position and restrict fluid flow through the casing or tubing string when in a closed position as shown. When the valve 200 is in a closed position, an operator can detect a change in pressure within the wellbore and can cease pumping the cement composition into the annulus.

The acquisition and measurement apparatus 111 is configured to send instructions to the actuator 112 to close the valve 200 after the acquisition and measurement apparatus determines a desired slope change within the pre-programmed slope change profile. The acquisition and measurement apparatus 111 can also be configured to send instructions to the actuator 112 to close the valve 200 after the acquisition and measurement apparatus receives the desired slope change and a desired resistivity value. By way of a specific example with reference to FIG. 5, if the pre-determined resistivity of the cement composition is 0.4 Ω-m and the pre-determined resistivity of the drilling fluid or spacer fluid is 3 Ω-m, then the desired slope change on the calculated measurement for resistivity can be from a negative slope to a positive slope (for example, similar to the plot of dr/dt shown in FIG. 8C). Accordingly, the desired derivative of resistivity reading can correspond to a 20% cement/

80% spacer fluid mixture to 100% cement composition. In this manner, an operator can ensure that the cement composition has filled the annulus and is present at the location of the resistivity sensor 110.

The acquisition and measurement apparatus 111 can instruct the actuator 112 to close the valve 200 after the desired slope change is determined by the acquisition and measurement apparatus. According to any of the embodiments, the acquisition and measurement apparatus sends the instruction to the actuator 112 to close the valve a desired time after determining the desired slope change based on the average derivative of resistivity with respect to time from the resistivity measurements by the resistivity sensor 110. By way of a first example, if the desired slope change corresponds to less than 100% cement composition, then the acquisition and measurement apparatus can wait 15 minutes to send the instruction to the actuator to close the valve. In this manner, proper placement of the cement composition is ensured. The desired time after determining the desired slope change can vary and can range from 1 minute (preferably if the desired slope change corresponds to 100% cement) to 15 minutes. According to any of the embodiments, the instruction to close the valve is sent at the earliest possible time when proper cement placement can be ensured. This can save money by not needlessly pumping more cement into the annulus. It is to be understood that the acquisition and measurement apparatus 111 is pre-programmed at the wellhead with the specific slope change profile based on the calculated measurement for the average derivative of resistivity with respect to time and autonomously sends the instruction to the actuator when the desired slope change is determined.

As fluids flow through the annulus and into the casing or tubing string, formation fluids can mix with the fluids. By way of example, a drilling mud can become mixed with formation fluids before flowing past the sensor. This mixing with formation fluids can unknowingly alter the resistivity of the mud. Therefore, the slope changes can cause premature closing of the valve. According to any of the embodiments, the acquisition and measurement apparatus 111 instructs the actuator 112 to close the valve 200 only when the desired slope change is determined, a period of time has elapsed, and the slope change is still the same as the desired slope change. Of course, multiple checks can be pre-programmed into the acquisition and measurement apparatus to ensure that premature closure of the valve does not occur and that the determined slope changes based on the average derivative of resistivity with respect to time are the same as the desired slope change within the slope change profile.

Any of the components of the sensor device 100 can be housed within a housing. The housing can protect the components from damage by wellbore fluids. The housing can ensure that the components can function properly and for the intended duration of use.

A second sensor can also be used in conjunction with the resistivity sensor device. A second sensor can be used as a back-up sensor to ensure that the valve is closed at a desired time. The second sensor can include, for example, a magnetic sensor. The second sensor can be connected to the acquisition and measurement apparatus 111 and the actuator 112. Additional ingredients can be added to the cement composition, such as a magnetic mineral (e.g., magnetite), such that the magnetic sensor can detect the presence of the cement composition. The second sensor can be located inside the casing string or tubing string adjacent to the resistivity sensor 110. The acquisition and measurement apparatus can also be pre-programmed with a magnetic profile of test fluids. Magnetite increases the density of a fluid. Therefore, a maximum amount of magnetite can be added to a fluid before undesirable fluid properties occur. One of the many advantages to the derivative of resistivity sensor is that the sensitivity of the sensor device is much greater than a sensor utilizing only resistivity values. Accordingly, there is a much greater flexibility in fluid composition designs, such as desirable densities, viscosities, etc., as opposed to sensors relying on actual resistivity values.

An embodiment of the present disclosure is a method of detecting the presence of a cement composition in a reverse cementing operation in a wellbore comprising: introducing a sensor device into the wellbore, the sensor device comprising: (A) a resistivity sensor configured to measure the resistivity of a fluid; (B) an acquisition and measurement apparatus configured to: (i) process the measured resistivity to determine an average derivative of resistivity with respect to time; (ii) determine a plurality of slope changes based on the average derivative of resistivity with respect to time; (iii) be pre-programmed with a slope change profile of the slope changes; and (iv) receive readings from the resistivity sensor; (C) an actuator configured to receive instructions from the acquisition and measurement apparatus; and (D) a valve, wherein the valve is located inside of a casing string or tubing string, wherein the acquisition and measurement apparatus is configured to send instructions to the actuator to close the valve after the acquisition and measurement apparatus determines a desired slope change within the pre-programmed slope change profile; pre-programming the acquisition and measurement apparatus with the desired slope change and the slope change profile; introducing a first fluid into the wellbore; introducing a cement composition into an annulus of the wellbore; allowing the resistivity sensor to measure the resistivity of the first fluid and the cement composition; and allowing the acquisition and measurement apparatus to instruct the actuator to close the valve. Optionally, the methods further include wherein the resistivity sensor comprises a source of electrical current, a voltage measurement system, electrodes, and cables. Optionally, the methods further include wherein the acquisition and measurement apparatus is a controller board. Optionally, the methods further include wherein the resistivity of the first fluid is different from the resistivity of the cement composition. Optionally, the methods further include wherein the first fluid is a drilling mud or a spacer fluid. Optionally, the methods further include introducing a second fluid into the wellbore, wherein the second fluid is introduced into the wellbore after the first fluid and before the cement composition, wherein the first fluid is a drilling mud, and wherein the second fluid is a spacer fluid. Optionally, the methods further include: pre-determining the resistivity for the first fluid and the cement composition prior to introduction of the sensor device into the wellbore; and pre-determining the plurality of slope changes based on the average derivative of resistivity with respect to time for the first fluid and the cement composition. Optionally, the methods further include wherein pre-determining the resistivity for the first fluid and the cement composition comprises: preparing a first and second test fluid, wherein the first test fluid is identical to the first fluid and the second test fluid is identical to the cement composition; and measuring the resistivity of the test fluids. Optionally, the methods further include estimating the lengths of time that each of the first fluid and the cement composition flow past the resistivity sensor. Optionally, the methods further include wherein the desired slope change within the pre-programmed slope change profile of the slope changes is determined based on the average derivative of resistivity with respect to time of the first test fluid and the second test fluid, and the lengths of time. Optionally, the methods further include wherein the acquisition and measurement apparatus sends instructions to the actuator to close the valve after the acquisition and measurement apparatus determines the desired slope change and the desired slope change is confirmed after a period of time. Optionally, the methods further include wherein the desired slope change corresponds to the cement composition being in a concentration in a range from 20% to 100% by volume. Optionally, the methods further include wherein the acquisition and measurement apparatus sends the instructions to the actuator to close the valve a desired period of time after determining the desired slope change. Optionally, the methods further include introducing a second sensor into the wellbore, wherein the second sensor is located near the resistivity sensor, wherein the second sensor measures a property of the first fluid, the cement composition, or the first fluid and the cement composition; pre-programming the acquisition and measurement apparatus with a profile of the property; and allowing the second sensor to measure the property of the first fluid, the cement composition, or the first fluid and the cement composition. Optionally, the methods further include wherein the property is a change in a magnetic field or capacitance. Optionally, the methods further include wherein the second sensor is a magnetic sensor or a capacitance sensor. Optionally, the methods further include wherein the first fluid or the cement composition comprises a magnetic mineral, or wherein the first fluid and the cement composition comprise a magnetic mineral in different concentrations.

Another embodiment of the present disclosure is a reverse cementing sensor device comprising: a resistivity sensor configured to measure the resistivity of a fluid; an acquisition and measurement apparatus configured to: (i) process the measured resistivity to determine an average derivative of resistivity with respect to time; (ii) determine a plurality of slope changes based on the average derivative of resistivity with respect to time; (iii) be pre-programmed with a slope change profile of the slope changes; and (iv) receive readings from the resistivity sensor; an actuator configured to receive instructions from the acquisition and measurement apparatus; and a valve, wherein the valve is located inside of a casing string or tubing string, wherein the acquisition and measurement apparatus is configured to send instructions to the actuator to close the valve after the acquisition and measurement apparatus determines a desired slope change within the pre-programmed slope change profile. Optionally, the sensor device further includes wherein the resistivity sensor comprises a source of electrical current, a voltage measurement system, electrodes, and cables. Optionally, the sensor device further includes wherein the acquisition and measurement apparatus is a controller board. Optionally, the sensor device further includes wherein the resistivity of the first fluid is different from the resistivity of the cement composition. Optionally, the sensor device further includes wherein the first fluid is a drilling mud or a spacer fluid. Optionally, the sensor device further includes introducing a second fluid into the wellbore, wherein the second fluid is introduced into the wellbore after the first fluid and before the cement composition, wherein the first fluid is a drilling mud, and wherein the second fluid is a spacer fluid. Optionally, the sensor device further includes: pre-determining the resistivity for the first fluid and the cement composition prior to introduction of the sensor device into the wellbore; and pre-determining the plurality of slope changes based on the average derivative of resistivity with respect to time for the first fluid and the cement composition. Optionally, the sensor device further includes wherein pre-determining the resistivity for the first fluid and the cement composition comprises: preparing a first and second test fluid, wherein the first test fluid is identical to the first fluid and the second test fluid is identical to the cement composition; and measuring the resistivity of the test fluids. Optionally, the sensor device further includes estimating the lengths of time that each of the first fluid and the cement composition flow past the resistivity sensor. Optionally, the sensor device further includes wherein the desired slope change within the pre-programmed slope change profile of the slope changes is determined based on the average derivative of resistivity with respect to time of the first test fluid and the second test fluid, and the lengths of time. Optionally, the sensor device further includes wherein the acquisition and measurement apparatus sends instructions to the actuator to close the valve after the acquisition and measurement apparatus determines the desired slope change and the desired slope change is confirmed after a period of time. Optionally, the sensor device further includes wherein the desired slope change corresponds to the cement composition being in a concentration in a range from 20% to 100% by volume. Optionally, the sensor device further includes wherein the acquisition and measurement apparatus sends the instructions to the actuator to close the valve a desired period of time after determining the desired slope change. Optionally, the sensor device further includes introducing a second sensor into the wellbore, wherein the second sensor is located near the resistivity sensor, wherein the second sensor measures a property of the first fluid, the cement composition, or the first fluid and the cement composition; pre-programming the acquisition and measurement apparatus with a profile of the property; and allowing the second sensor to measure the property of the first fluid, the cement composition, or the first fluid and the cement composition. Optionally, the sensor device further includes wherein the property is a change in a magnetic field or capacitance. Optionally, the sensor device further includes wherein the second sensor is a magnetic sensor or a capacitance sensor. Optionally, the sensor device further includes wherein the first fluid or the cement composition comprises a magnetic mineral, or wherein the first fluid and the cement composition comprise a magnetic mineral in different concentrations.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more fluids, sensors, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of detecting the presence of a cement composition in a reverse cementing operation in a wellbore comprising:

introducing a sensor device into the wellbore, the sensor device comprising:

(A) a resistivity sensor configured to measure the resistivity of a fluid;

(B) an acquisition and measurement apparatus configured to:

(i) process the measured resistivity to determine an average derivative of resistivity with respect to time;

(ii) determine a plurality of slope changes based on the average derivative of resistivity with respect to time;

(iii) be pre-programmed with a slope change profile of the slope changes; and (iv) receive readings from the resistivity sensor;

(C) an actuator configured to receive instructions from the acquisition and measurement apparatus; and (D) a valve, wherein the valve is located inside of a casing string or tubing string, wherein the acquisition and measurement apparatus is configured to send instructions to the actuator to close the valve after the acquisition and measurement apparatus determines a desired slope change within the pre-programmed slope change profile;

pre-programming the acquisition and measurement apparatus with the desired slope change and the slope change profile;

introducing a first fluid into the wellbore;

introducing a cement composition into an annulus of the wellbore;

allowing the resistivity sensor to measure the resistivity of the first fluid and the cement composition; and allowing the acquisition and measurement apparatus to instruct the actuator to close the valve.

2. The method according to claim 1, wherein the resistivity sensor comprises a source of electrical current, a voltage measurement system, electrodes, and cables.

3. The method according to claim 1, wherein the acquisition and measurement apparatus is a controller board.

4. The method according to claim 1, wherein the resistivity of the first fluid is different from the resistivity of the cement composition.

5. The method according to claim 1, wherein the first fluid is a drilling mud or a spacer fluid.

6. The method according to claim 1, further comprising introducing a second fluid into the wellbore, wherein the second fluid is introduced into the wellbore after the first fluid and before the cement composition, wherein the first fluid is a drilling mud, and wherein the second fluid is a spacer fluid.

7. The method according to claim 1, further comprising: pre-determining the resistivity for the first fluid and the cement composition prior to introduction of the sensor device into the wellbore; and pre-determining the plurality of slope changes based on the average derivative of resistivity with respect to time for the first fluid and the cement composition.

8. The method according to claim 7, wherein pre-determining the resistivity for the first fluid and the cement composition comprises: preparing a first and second test fluid, wherein the first test fluid is identical to the first fluid and the second test fluid is identical to the cement composition; and measuring the resistivity of the test fluids.

9. The method according to claim 7, further comprising estimating the lengths of time that each of the first fluid and the cement composition flow past the resistivity sensor.

10. The method according to claim 9, wherein the desired slope change within the pre-programmed slope change profile of the slope changes is determined based on the average derivative of resistivity with respect to time of the first test fluid and the second test fluid, and the lengths of time.

11. The method according to claim 1, wherein the acquisition and measurement apparatus sends instructions to the actuator to close the valve after the acquisition and measurement apparatus determines the desired slope change and the desired slope change is confirmed after a period of time.

12. The method according to claim 11, wherein the desired slope change corresponds to the cement composition being in a concentration in a range from 20% to 100% by volume.

13. The method according to claim 11, wherein the acquisition and measurement apparatus sends the instructions to the actuator to close the valve a desired period of time after determining the desired slope change.

14. The method according to claim 1, further comprising:

introducing a second sensor into the wellbore, wherein the second sensor is located near the resistivity sensor, wherein the second sensor measures a property of the first fluid, the cement composition, or the first fluid and the cement composition;

pre-programming the acquisition and measurement apparatus with a profile of the property; and allowing the second sensor to measure the property of the first fluid, the cement composition, or the first fluid and the cement composition.

15. The method according to claim 14, wherein the property is a change in a magnetic field or capacitance.

16. The method according to claim 15, wherein the second sensor is a magnetic sensor or a capacitance sensor.

17. The method according to claim 15, wherein the first fluid or the cement composition comprises a magnetic mineral, or wherein the first fluid and the cement composition comprise a magnetic mineral in different concentrations.

18. A reverse cementing sensor device comprising:

a resistivity sensor configured to measure the resistivity of a fluid;

an acquisition and measurement apparatus configured to:

(i) process the measured resistivity to determine an average derivative of resistivity with respect to time;

(ii) determine a plurality of slope changes based on the average derivative of resistivity with respect to time;

(iii) be pre-programmed with a slope change profile of the slope changes; and (iv) receive readings from the resistivity sensor;

an actuator configured to receive instructions from the acquisition and measurement apparatus; and a valve, wherein the valve is located inside of a casing string or tubing string, wherein the acquisition and measurement apparatus is configured to send instructions to the actuator to close the valve after the acquisition and measurement apparatus determines a desired slope change within the pre-programmed slope change profile.

19. The sensor device according to claim 18, further comprising: pre-determining the resistivity for a first fluid and a cement composition; pre-determining the plurality of slope changes based on the average derivative of resistivity with respect to time for the first fluid and the cement composition; and estimating the lengths of time that each of the first fluid and the cement composition flow past the resistivity sensor.

20. The sensor device according to claim 19, wherein the desired slope change within the pre-programmed slope change profile of the slope changes is determined based on the average derivative of resistivity with respect to time of the first fluid and the cement composition, and the lengths of time.

* * * * *